US009346649B2

(12) United States Patent
Yamashita et al.

(10) Patent No.: US 9,346,649 B2
(45) Date of Patent: May 24, 2016

(54) FINISHER, IMAGE FORMING APPARATUS AND IMAGE FORMING SYSTEM

(71) Applicant: KYOCERA Document Solutions Inc., Osaka-shi, Osaka (JP)

(72) Inventors: Keisuke Yamashita, Osaka (JP); Hideo Tanii, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 14/619,084

(22) Filed: Feb. 11, 2015

(65) Prior Publication Data

US 2015/0232298 A1 Aug. 20, 2015

(30) Foreign Application Priority Data

Feb. 20, 2014 (JP) ..... 2014-030289

(51) Int. Cl.
*B65H 43/06* (2006.01)
*B65H 31/10* (2006.01)

(52) U.S. Cl.
CPC ..... *B65H 43/06* (2013.01); *B65H 31/10* (2013.01); *B65H 2511/152* (2013.01); *B65H 2511/414* (2013.01); *B65H 2511/512* (2013.01); *B65H 2513/512* (2013.01); *B65H 2515/60* (2013.01); *B65H 2553/414* (2013.01); *B65H 2601/271* (2013.01); *B65H 2801/06* (2013.01)

(58) Field of Classification Search
CPC ..... B65H 7/02; B65H 7/14; B65H 7/20; B65H 31/08; B65H 31/10; B65H 43/06; B65H 43/08; B65H 2301/132; B65H 2301/1321; B65H 2401/22; B65H 2511/152; B65H 2511/181; B65H 2511/413; B65H 2511/512; B65H 2515/60; B65H 2553/31; B65H 2553/313; B65H 2601/271; B65H 2701/1242; G03G 2215/006611; G03G 2215/00616; G03G 2215/0061; G03G 2215/00755; G03G 2215/00759; G03G 2215/00911
USPC ..... 271/207, 214, 215, 217
See application file for complete search history.

(56) References Cited

U.S. PATENT DOCUMENTS 5,961,115 A * 10/1999 Blanck ..... B65H 43/06 270/52.06
6,176,480 B1 * 1/2001 Yonenuma ..... B65H 29/00 270/58.08
7,976,018 B2 * 7/2011 Ueda ..... B65H 31/02 271/176
8,385,764 B2 * 2/2013 Takahashi ..... G03G 15/2039 399/69

FOREIGN PATENT DOCUMENTS

JP 2001294362 A 10/2001

* cited by examiner

*Primary Examiner* — Ernesto Suarez

(57) ABSTRACT

A finisher includes an ejection port, a stacking tray, a light-emitting element, a light-receiving element, a communication section that performs data communication with an image forming apparatus and acquires a coverage rate of paper stacked on the stacking tray, and a paper-amount determination section that determines whether the amount of paper on the stacking tray exceeds a predetermined stack capacity of the stacking tray by comparing a predetermined threshold value with the amount of light received by the light-receiving element. The paper-amount determination section corrects the threshold value by using the coverage rate acquired by the communication section, compares the corrected threshold value with the amount of the light received by the light-receiving element, and determines that the amount of the paper stacked on the stacking tray exceeds the stack capacity of the stacking tray if the light amount is equal to or greater than the corrected threshold value.

11 Claims, 12 Drawing Sheets

FIG.6

| COVERAGE RATE | CORRECTION VALUE |
|---|---|
| 0 ~ X1 | NO CORRECTION |
| X1 ~ X2 | Y1 ( < 1 ) |
| X2 ~ X3 | Y2 ( < Y1 ) |
| X3 ~ X4 | Y3 ( < Y2 ) |

FIG.8A

| COVERAGE RATE | MAGENTA CORRECTION VALUE |
|---|---|
| 0 ~ X1 | NO CORRECTION |
| X1 ~ X2 | Y4 ( < 1 ) |
| X2 ~ X3 | Y5 ( < Y4 ) |
| X3 ~ X4 | Y6 ( < Y5 ) |

FIG.8B

| COVERAGE RATE | CYAN CORRECTION VALUE |
|---|---|
| 0 ~ X1 | NO CORRECTION |
| X1 ~ X2 | Y7 ( < 1 ) |
| X2 ~ X3 | Y8 ( < Y7 ) |
| X3 ~ X4 | Y9 ( < Y8 ) |

FIG.8C

| COVERAGE RATE | YELLOW CORRECTION VALUE |
|---|---|
| 0 ~ X1 | NO CORRECTION |
| X1 ~ X2 | Y10 ( < 1 ) |
| X2 ~ X3 | Y11 ( < Y10 ) |
| X3 ~ X4 | Y12 ( < Y11 ) |

FINISHER, IMAGE FORMING APPARATUS AND IMAGE FORMING SYSTEM

INCORPORATION BY REFERENCE

The disclosure of Japanese Patent Application No. 2014-30289 filed on Feb. 20, 2014 including the specification, drawings and abstract is incorporated herein by reference in its entirety.

BACKGROUND

This disclosure relates to a finisher, an image forming apparatus, and an image forming system.

Finishers are well known that are coupled to an image forming apparatus and provide post-printing processes, such as stapling, to sheets of paper on which images have been formed by the image forming apparatus. The sheets of paper subjected to the post-printing processes by the finisher are then ejected through an ejection port of the finisher to a stacking tray of the finisher.

If the sheets are stacked on the stacking tray beyond its capacity, the sheets may fall from the stacking tray. To prevent this, some finishers are provided with an optical sensor for detecting the amount of paper stacked on the stacking tray. If the output value from the sensor reaches a predetermined threshold value or beyond, the finisher determines that the amount of paper stacked on the stacking tray exceeds the stack capacity of the stacking tray, and delivery of the paper from the image forming apparatus to the finisher is suspended.

SUMMARY

A finisher according to an aspect of the present disclosure includes an ejection port, a stacking tray, a light-emitting element, a light-receiving element, a communication section, and a paper-amount determination section. Sheets of paper are ejected from the ejection port. The sheets of paper ejected from the ejection port are stacked on the stacking tray. The light-emitting element emits light to the top sheet of a paper stack on the stacking tray. The light-receiving element receives light that is emitted from the light-emitting element and then reflected off the top sheet of the paper stack on the stacking tray. The communication section performs data communication with an image forming apparatus and acquires a coverage rate of a side of the top sheet of the paper stack on the stacking tray. The side is exposed to light emitted from the light-emitting element. The paper-amount determination section compares the amount of light received by the light-receiving element with a predetermined threshold value to determine whether or not the amount of paper stacked on the stacking tray exceeds a predetermined stack capacity of the stacking tray. The paper-amount determination section corrects the threshold value by using the coverage rate acquired by the communication section, compares the corrected threshold value with the amount of light received by the light-receiving element, and determines that the amount of paper stacked on the stacking tray exceeds the stack capacity of the stacking tray if the light amount is equal to or greater than the corrected threshold value.

An image forming apparatus according to another aspect of the present disclosure includes an image forming unit, an ejection port, a stacking tray, a light-emitting element, a light-receiving element, a coverage-rate calculation section, and a paper-amount determination section. The image forming unit forms an image on sheets of paper. The sheets of paper on which the image has been formed by the image forming unit are ejected from the ejection port. The sheets of paper ejected from the ejection port are stacked on the stacking tray. The light-emitting element emits light to the top sheet of a paper stack on the stacking tray. The light-receiving element receives light that is emitted from the light-emitting element and then reflected off the top sheet of the paper stack on the stacking tray. The coverage-rate calculation section calculates a coverage rate of a side of the top sheet of the paper stack on the stacking tray. The side is exposed to light emitted from the light-emitting element. The paper-amount determination section compares the amount of light received by the light-receiving element with a predetermined threshold value to determine whether or not the amount of paper stacked on the stacking tray exceeds a predetermined stack capacity of the stacking tray. The paper-amount determination section corrects the threshold value by using the coverage rate calculated by the coverage-rate calculation section, compares the corrected threshold value with the amount of light received by the light-receiving element, and determines that the amount of paper stacked on the stacking tray exceeds the stack capacity of the stacking tray if the light amount is equal to or greater than the corrected threshold value.

An image forming system according to yet another aspect of the present disclosure includes an image forming apparatus and a finisher. The finisher is coupled to the image forming apparatus. The image forming apparatus includes an image forming unit and a coverage-rate calculation section. The image forming unit forms an image on sheets of paper. The coverage-rate calculation section calculates a coverage rate of a sheet of paper on which an image has been formed by the image forming unit. The finisher includes an ejection port, a stacking tray, a light-emitting element, a light-receiving element, a communication section, and a paper-amount determination section. The sheets on which the image has been formed by the image forming unit are ejected through the ejection port. The sheets ejected from the ejection port are stacked on the stacking tray. The light-emitting element emits light to the top sheet of a paper stack on the stacking tray. The light-receiving element receives light that is emitted from the light-emitting element and then reflected off the top sheet of the paper stack on the stacking tray. The communication section performs data communication with the image forming apparatus and acquires a coverage rate calculated by the coverage-rate calculation section. The paper-amount determination section compares the amount of light received by the light-receiving element with a predetermined threshold value to determine whether or not the amount of paper stacked on the stacking tray exceeds a predetermined stack capacity of the stacking tray. The paper-amount determination section corrects the threshold value by using the coverage rate acquired by the communication section, compares the corrected threshold value with the amount of light received by the light-receiving element, and determines that the amount of paper stacked on the stacking tray exceeds the stack capacity of the stacking tray if the light amount is equal to or greater than the corrected threshold value.

BRIEF DESCRIPTION OF THE DRAWINGS

FIG. 6 is a table showing the corresponding relationship between paper coverage rates and correction values.

FIG. 8A is a table showing the corresponding relationship between magenta coverage rates and correction values.

FIG. 8B is a table showing the corresponding relationship between cyan coverage rates and correction values.

FIG. 8C is a table showing the corresponding relationship between yellow coverage rates and correction values.

DETAILED DESCRIPTION

Figure 1:
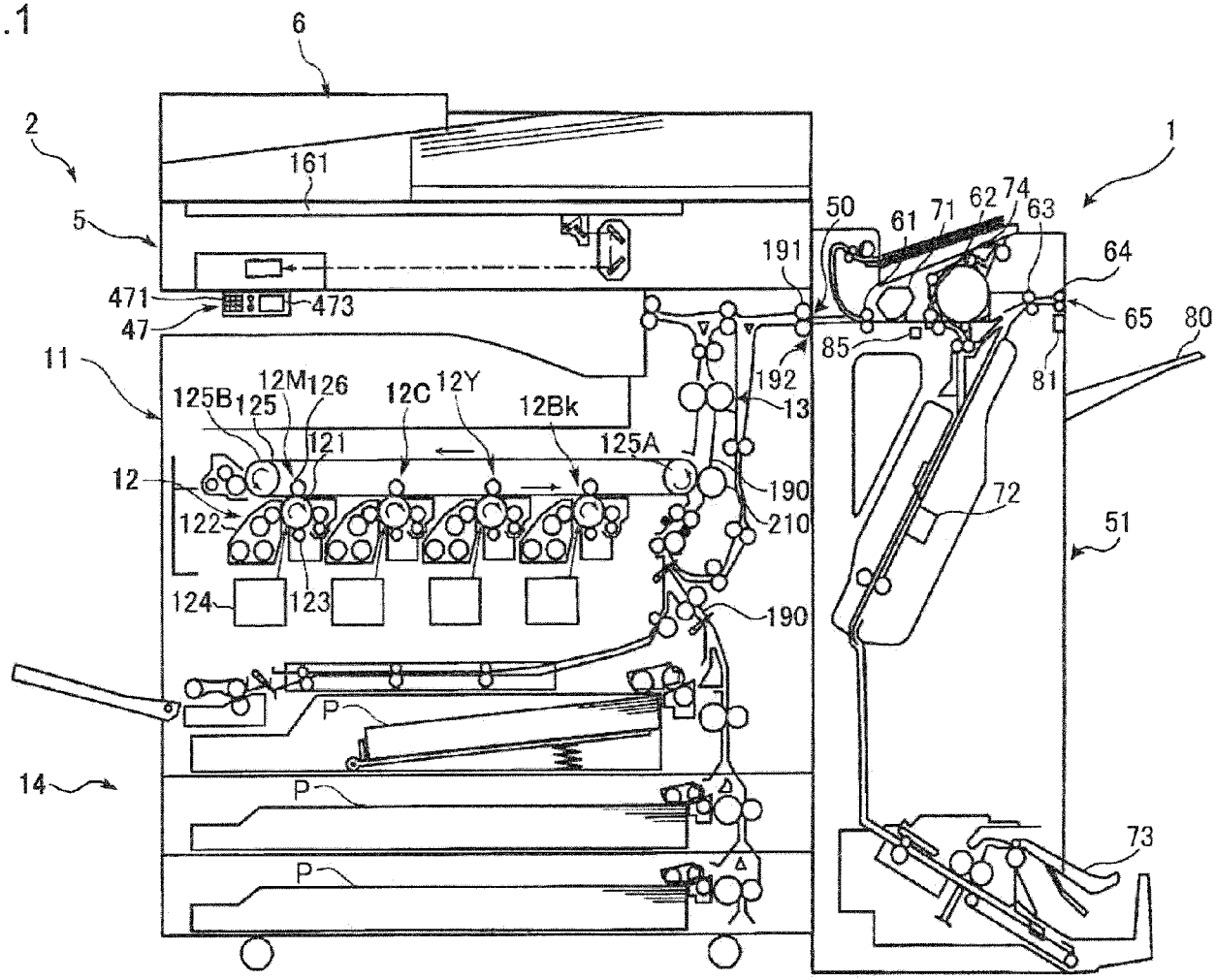
FIG. 1 illustrates the structure of a finisher and an image forming apparatus according to an embodiment of the present disclosure.

With reference to the accompanying drawings, descriptions will be made about a finisher, an image forming apparatus, and an image forming system according to an embodiment of the present disclosure. FIG. 1 illustrates the structure of a finisher and an image forming apparatus (an image forming system) according to the embodiment of the disclosure.

The image forming system according to the embodiment of the disclosure includes a finisher 1 and an image forming apparatus 2. The finisher 1 is coupled to the image forming apparatus 2 so that paper P on which an image is formed is ejected from an ejection port 192 of the image forming apparatus 2 and is received through a paper acceptance port 50 of the finisher 1. The finisher 1 and the image forming apparatus 2 are coupled to each other through a communication cable and can perform data communication therebetween through a communication interface unit 70 of the finisher 1 and a communication interface unit 49 of the image forming apparatus 2 (see FIG. 4), which will be described later.

First, the configuration of the image forming apparatus 2 will be described. The image forming apparatus 2 is a multifunctional peripheral having a plurality of functions, for example, a copying function, a printing function, a scanning function, and a facsimile function. The image forming apparatus 2 has a main body 11 provided with an operation unit 47, an image forming unit 12, a fixing unit 13, a paper feeding unit 14, a document feeding unit 6, a document reading unit 5 and other components.

The operation unit 47 accepts user's instructions to perform various operations and processing executable by the finisher 1 and various operations and processing executable by the image forming apparatus 2.

When the image forming apparatus 2 reads an original document, the document reading unit 5 optically reads images of the original document fed by the document feeding unit 6 or placed on a document placement glass 161 to generate image data.

When the image forming apparatus 2 forms an image, the image forming unit 12 forms the image on the paper P fed from the paper feeding unit 14 based on the image data generated through the above-described document reading operation or image data transmitted from a computer connected with the image forming apparatus 2 via a network. The image forming unit 12 includes image forming sub-units 12M, 12C, 12Y, and 12Bk, each being provided with a photoconductive drum 121, a development device 122 that supplies toner to the photoconductive drum 121, a toner cartridge (not shown) that contains toner, a charging device 123, an exposure device 124, and a primary transfer roller 126.

In color printing, the image forming sub-unit 12M for magenta, image forming sub-unit 12C for cyan, image forming sub-unit 12Y for yellow, and image forming sub-unit 12Bk for black of the image forming unit 12 respectively form toner images on the photoconductive drums 121, based on the image composed of the respective colors making up image data, through charging, exposing and developing processes, and then the toner images are transferred onto an intermediate transfer belt 125 extended between a driving roller 125A and a driven roller 125B by the primary transfer roller 126.

The intermediate transfer belt 125 has an outer circumferential surface that is an image carrying surface on which the toner images are transferred and is driven by the driving roller 125A in contact with a circumferential surface of the photoconductive drum 121. The intermediate transfer belt 125 endlessly travels between the driving roller 125A and driven roller 125B in synchronization with each photoconductive drum 121.

The toner images of respective colors to be transferred onto the intermediate transfer belt 125 are overlaid on one another on the intermediate transfer belt 125 to form a color toner image. A secondary transfer roller 210 transfers the color toner image, which is formed on the surface of the intermediate transfer belt 125, onto paper P, which is sent through a transport path 190 from the paper feeding unit 14, at a nip portion provided between the driving roller 125A and the secondary transfer roller 210 with the intermediate transfer belt 125 sandwiched therebetween. Subsequently, the fixing unit 13 fixes the toner image on the paper P by thermocompression bonding. The paper P on which the image has been formed through the fixing process is ejected by a pair of ejection rollers 191 from the ejection port 192 and is then inserted into the paper acceptance port 50 of the finisher 1.

Second, the configuration of the finisher 1 will be described. The finisher 1 includes a main body 51 provided with pairs of transport rollers 61, 62, 63, a pair of ejection rollers 64, a punching unit 71, a stapling unit 72, a bookbinding unit 73, a standby drum 74, a stacking tray 80, a paper-amount detection sensor 81 and other components.

The paper P, which is fed from the paper acceptance port 50 to the finisher 1, is transported by the pairs of transport rollers 61, 62, 63. The transported paper P is subjected to post-printing processes at predetermined positions in the finisher 1 by the punching unit 71, stapling unit 72, bookbinding unit 73 and so on. In a case where the post-printing processes cannot be performed on the transported paper P in time, the paper P is temporarily held on the standby drum 74. The processed paper P is ejected by the pair of ejection rollers 64 from an ejection port 65. The stacking tray 80 is provided below the ejection port 65, and the paper P ejected from the ejection port 65 is stacked on the stacking tray 80.

Figure 2:
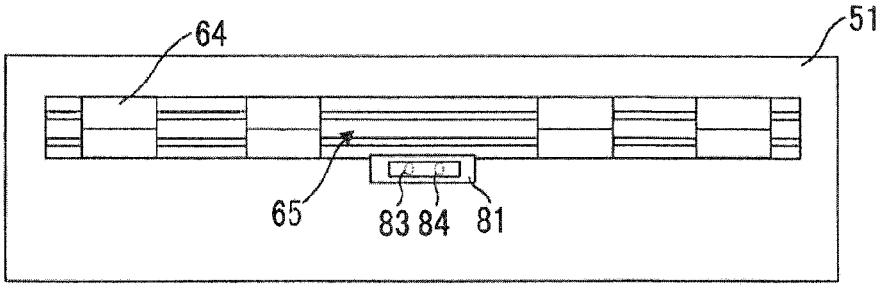
FIG. 2 illustrates the structure around an ejection port of the finisher according to the embodiment of the disclosure.

FIG. 2 illustrates the structure around the ejection port 65 of the finisher 1. As shown in FIG. 2, the paper-amount detection sensor 81 is disposed in the vicinity of the ejection port 65 above the stacking tray 80. The paper-amount detection sensor 81 is a so-called reflective sensor and has a light-emitting element 83 and a light-receiving element 84. The light-emitting element 83 is an element that emits light, such as an LED, and is arranged so as to direct the main light emission direction to the stacking tray 80, thereby emitting visible light to the stacking tray 80. The light-receiving element 84 is an element that receives light, such as a photodiode and a phototransistor, and is arranged so as to direct the main light reception direction to the stacking tray 80, thereby receiving the visible light reflected off the stacking tray 80 or the paper P stacked on the stacking tray 80. The light-receiving element 84 photoelectrically converts the received visible light into a signal corresponding to the amount of the received visible light and outputs the signal to a paper-amount determination section 103 of a control unit 100 (see FIG. 4), which will be described later.

The paper-amount detection sensor 81 is a reflective visible-light sensor in this description; however, the present disclosure is not limited to this kind of sensor. The paper-amount detection sensor 81 may be, for example, a reflective infrared-ray sensor that emits an infrared ray, instead of visible light, and receives the infrared ray reflected off the stacking tray 80 or paper stacked on the stacking tray 80.

Figure 3A:
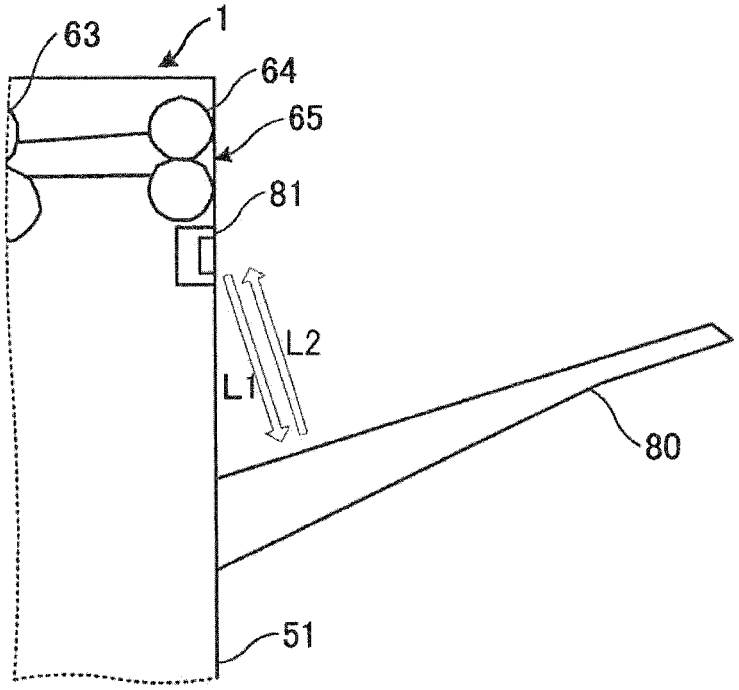
FIG. 3A illustrates light emitted from a light-emitting element and the reflected light when there are no sheets of paper on a stacking tray.
Figure 3B:
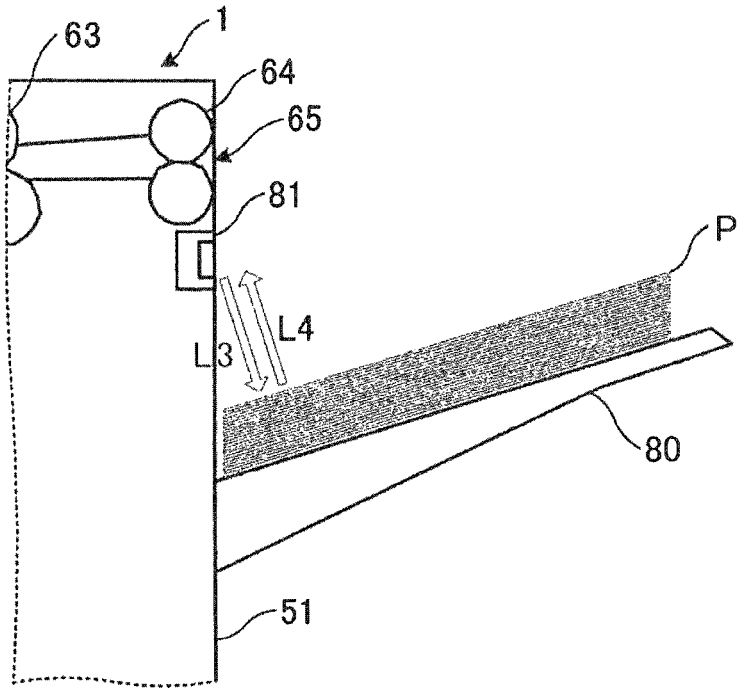
FIG. 3B illustrates light emitted from the light-emitting element and the reflected light when there are sheets of paper stacked on the stacking tray.

FIG. 3A illustrates light emitted from the light-emitting element 83 and the reflected light when there are no sheets of paper P stacked on the stacking tray 80. FIG. 3B illustrates light emitted from the light-emitting element 83 and the reflected light when there are sheets of paper P stacked on the stacking tray 80.

As shown in FIGS. 3A and 3B, the distance from a point from which light is emitted (emitting point) to a point at which the light is reflected (reflecting point) and the distance from the reflecting point to a point at which the light is received (receiving point) when sheets of paper P are stacked on the stacking tray 80 are shorter than the distances when no sheets of paper P are stacked on the stacking tray 80 by the height of the sheets of paper P stacked on the stacking tray 80. Therefore, the amount of light L4, which is the reflected light of light L3 emitted from the light-emitting element 83, reflected off the paper P on the stacking tray 80, and received by the light-receiving element 84, is larger than the amount of light L2, which is the reflected light of light L1 emitted from the light-emitting element 83, reflected off the stacking tray 80, and received by the light-receiving element 84. Similarly, the distances from the emitting point to the reflecting point and from the reflecting point to the receiving point decrease as the amount of the paper P stacked on the stacking tray 80 increases, resulting in that the amount of light received by the light-receiving element 84 increases. Thus, the amount of paper P stacked on the stacking tray 80 is proportional to the amount of light received by the light-receiving element 84, and therefore the paper-amount determination section 103 can calculate the amount of paper P stacked on the stacking tray 80 by acquiring the amount of light received by the light-receiving element 84.

Figure 4:
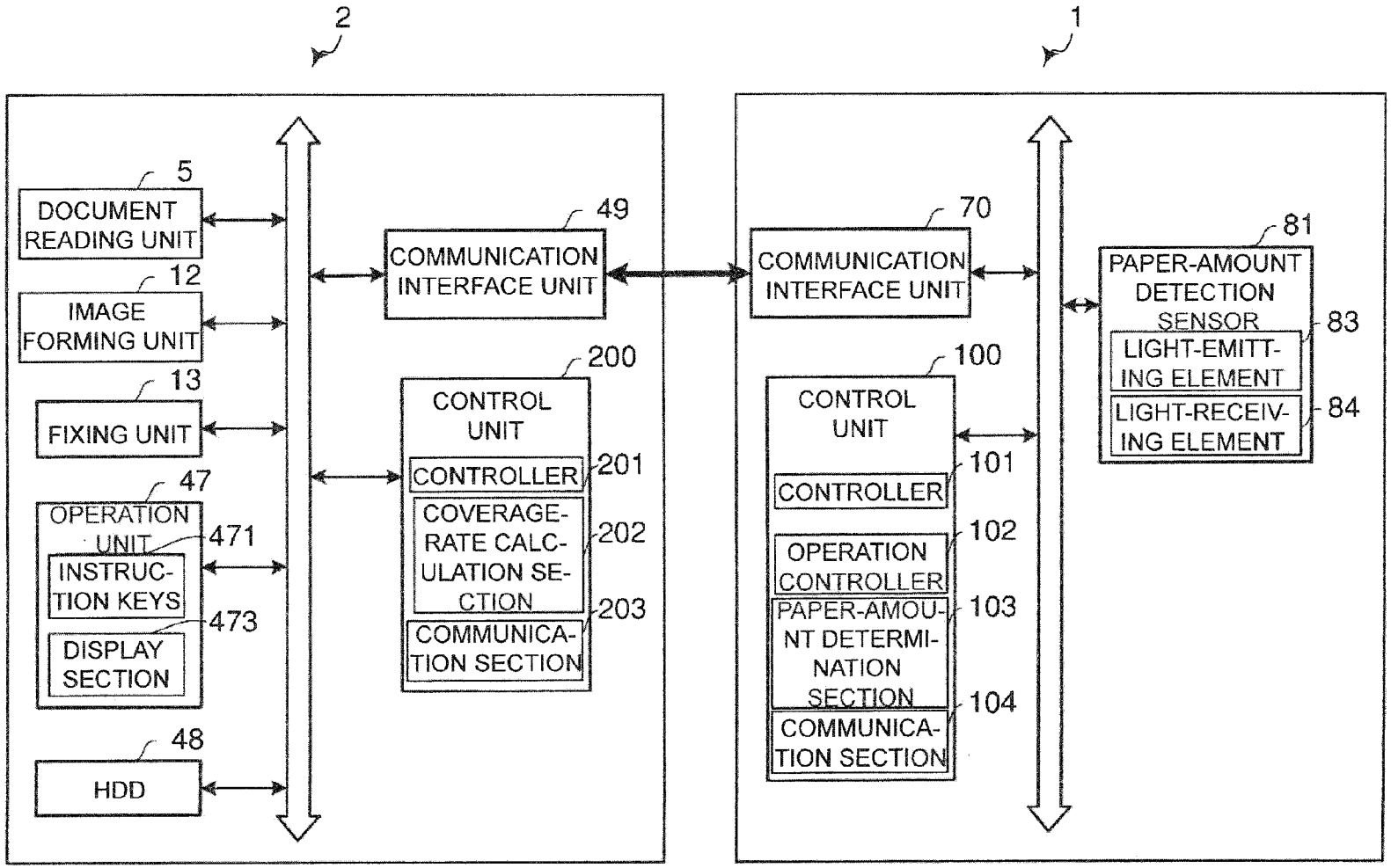
FIG. 4 is a block diagram showing the internal configuration of the finisher and image forming apparatus according to the embodiment of the disclosure.

A description is now given of the internal configuration of the finisher 1 and image forming apparatus 2. FIG. 4 is a block diagram of the internal configuration of the finisher 1 and image forming apparatus 2. The finisher 1 includes the communication interface unit 70, the paper-amount detection sensor 81, and the control unit 100.

The communication interface unit 70 includes a communication device, such as a serial communication device, and is connected to the communication interface unit 49 of the image forming apparatus 2. The finisher 1 receives information, various instructions, and requests transmitted via the communication interface unit 70 and communication interface unit 49 from the image forming apparatus 2, and also transmits various notifications to the image forming apparatus 2. The information transmitted from the image forming apparatus 2 may include, for example, information about a coverage rate of paper. The instructions transmitted from the image forming apparatus 2 may include, for example, an instruction about post-printing processes, such as stapling.

The control unit 100 includes a central processing unit (CPU), a random access memory (RAM), a read only memory (ROM) and other components. The control unit 100 functions by executing a finisher control program, which is stored in the ROM or other storage units, executed by the CPU, as a controller 101, an operation controller 102, a paper-amount determination section 103, and a communication section 104. The controller 101, operation controller 102, paper-amount determination section 103, and communication section 104 of the control unit 100 can be respectively implemented by hard circuits rather than implementation by the finisher control program.

The controller 101 exercises control over the entire finisher 1.

The operation controller 102 has a function of controlling the operations of the pairs of transport rollers 61, 62, 63, pair of ejection rollers 64, punching unit 71, stapling unit 72, bookbinding unit 73, standby drum 74 and other components.

The communication section 104 performs data communication with the image forming apparatus 2 via the communication interface unit 70 and communication interface unit 49 and acquires the coverage rate of the top sheet of paper P, calculated by the coverage-rate calculation section 202 of the image forming apparatus 2.

The paper-amount determination section 103 determines whether or not the amount of paper P stacked on the stacking tray 80 exceeds the allowable stack capacity of the stacking tray 80 by using the amount of light received by the light-receiving element 84 of the paper-amount detection sensor 81 and the coverage rate of the top sheet of the paper P calculated by the coverage-rate calculation section 202. More specifically, the paper-amount determination section 103 decreases a threshold value as the coverage rate acquired by the communication section 104 increases, compares the threshold value with the amount of light received by the light-receiving element 84. If the light amount is equal to or greater than the threshold value, the paper-amount determination section 103 determines that the amount of paper P stacked on the stacking tray 80 exceeds the allowable stack capacity of the stacking tray 80.

There is a difference in light reflectance between a white part and a black part on paper. While the white part resists absorbing light, but has a high reflectance, the black part is apt to absorb light, but has a low reflectance. These properties cause a difference in the amount of light received by the light-receiving element 84 of the paper-amount detection sensor 81 between paper with a low coverage rate and paper with a high coverage rate even though the sheets of both types of paper on the stacking tray 80 are the same in number. Because of this, the paper-amount determination section 103 uses smaller threshold values for the paper P with higher coverage rates in order to determine whether or not the amount of paper P stacked on the stacking tray 80 exceeds a predetermined allowable stack capacity of the stacking tray 80. This configuration allows the paper-amount determination section 103 to determine whether or not the amount of paper P on the stacking tray 80 exceeds the allowable stack capacity of the stacking tray with higher accuracy compared with conventional apparatuses.

The image forming apparatus 2 includes the document reading unit 5, the image forming unit 12, a fixing unit 13, the operation unit 47, a hard disk drive (HDD) 48, the communication interface unit 49, and a control unit 200.

The operation unit 47 includes a plurality of instruction keys 471 and a display section 473. The display section 473 is composed of a liquid crystal display or an organic EL display and displays a menu screen image or other screen images rendered by a controller 201 of the control unit 200, which will be described later.

The instruction keys 471 include, for example, a menu key to bring up the menu screen, arrow keys to move focus on the GUI making up the menu, an enter key to accept the operation on the GUI making up the menu, character input keys to input characters, numeric input keys to input numerals, and other keys. These keys are used by users to select operations associated with the menu displayed on the display section 473.

The HDD 48 is used to store image data and other types of data output from the document reading unit 5.

The communication interface unit 49 includes a communication device, such as a serial communication device, and is connected to the communication interface unit 70 of the finisher 1.

The control unit 200 includes a CPU, a RAM, a ROM and other components. The control unit 200 functions by executing an image-forming-apparatus control program, which is stored in the ROM or other storage units, executed by the CPU, as the controller 201, the coverage-rate calculation section 202, and a communication section 203. The controller 201, coverage-rate calculation section 202, and communication section 203 of the control unit 200 can be respectively implemented by hard circuits rather than implementation by the image-forming-apparatus control program.

The controller 201 exercises control over the entire image forming apparatus 2.

The coverage-rate calculation section 202 has a function of calculating the coverage rate of paper P on which an image is formed by the image forming unit 12. More specifically, the coverage-rate calculation section 202 calculates the ratio of pixels printed on paper P to all pixels contained in image data to be formed, as the coverage rate of the paper P. The coverage-rate calculation section 202 may sample the all pixels contained in the image data to be formed at a predetermined interval and may calculate the ratio of pixels to be printed to the sampled pixels to obtain the coverage rate of the paper P.

The communication section 203 performs data communication with the finisher 1 via the communication interface unit 49 and communication interface unit 70 to transmit the coverage rate calculated by the coverage-rate calculation section 202 to the finisher 1.

Figure 5:
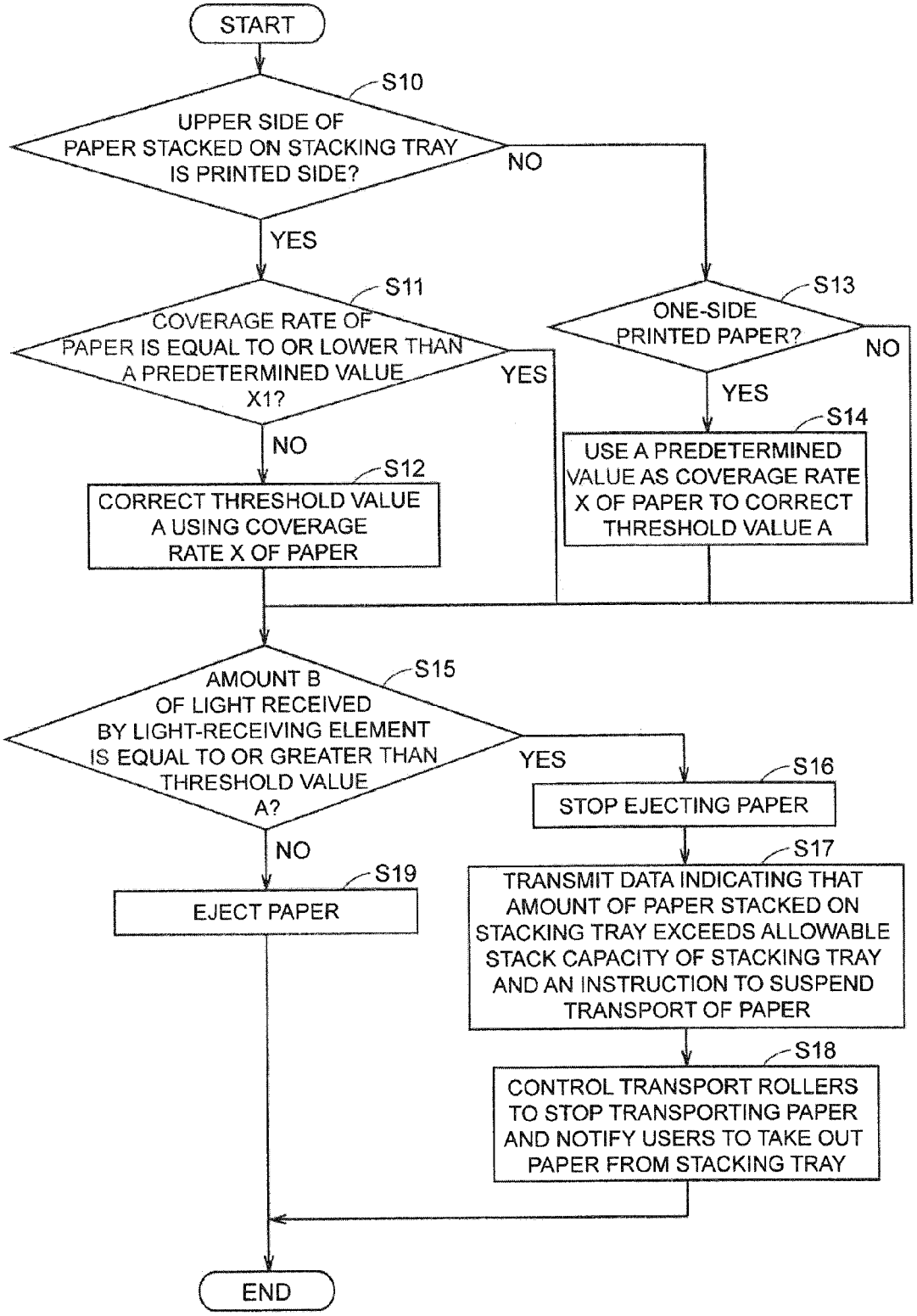
FIG. 5 is a flowchart showing an operational procedure performed by the finisher and image forming apparatus according to the embodiment of the disclosure.

A description is now given of the operation of the finisher 1 and image forming apparatus 2 configured as above. FIG. 5 is a flowchart showing the operational procedure performed by the finisher 1 and image forming apparatus 2.

The paper-amount determination section 103 of the finisher 1 determines whether or not the upper side of the top sheet of the paper P stacked on the stacking tray 80 is a printed side of the sheet (step S10). The information indicating whether or not the upper side of the top sheet of the paper P stacked on the stacking tray 80 is a printed side of the sheet is obtained by the communication section 104 from the image forming apparatus 2. The paper-amount determination section 103 refers to the obtained information to determine whether or not the upper side of the top sheet of the paper P stacked on the stacking tray 80 is a printed side of the sheet.

If the upper side of the top sheet of the paper P stacked on the stacking tray 80 is a printed side of the sheet (YES in step S10), the paper-amount determination section 103 determines whether or not the coverage rate X of the top sheet of the paper P obtained by the communication section 104 is equal to or lower than a predetermined value X1 (step S11).

If the coverage rate X of the paper P is not equal to or lower than the predetermined value X1 (NO in step S11), the paper-amount determination section 103 corrects a threshold value A, which is used to determine whether or not the amount of the paper P stacked on the stacking tray 80 exceeds the allowable stack capacity of the stacking tray 80, by using the coverage rate X of the paper P obtained by the communication section 104 (step S12). Specifically, the following equation is used to obtain a corrected threshold value A1, for example.

$A1=Y\times A0$ (where A0 is a threshold value before being corrected, and Y is a correction value)

The correction value Y in the equation is uniquely determined from the coverage rate of the paper P obtained by the communication section 104. FIG. 6 is a table showing the corresponding relationship between the coverage rates of the paper P and correction values Y. The finisher 1 having the table, as shown in FIG. 6, stored in the internal HDD or other storage units in advance refers to the table to choose a correction value Y based on the coverage rate X obtained by the communication section 104 and corrects the threshold value by using the chosen correction value Y. In the example shown in FIG. 6, when the coverage rate of the paper P is from X1 to X2, correction value Y1 (<1) is chosen, and when the coverage rate of the paper P is from X2 to X3, correction value Y2 (<Y1) is chosen. In short, the paper-amount determination section 103 chooses a smaller threshold value A with an increase in coverage rate X of the paper P.

If the coverage rate X of the paper P is equal to or lower than the predetermined value X1 (YES in step S11), the procedure goes to step S15 without correcting the threshold value in step S12, because lower coverage rates of the paper P hardly affect the reflectance.

If the upper side of the top sheet of the paper P stacked on the stacking tray 80 is not a printed side (NO in step S10), the paper-amount determination section 103 determines whether or not the paper P is paper printed on one side (step S13). The determination whether the paper P is one-side printed paper is made by users who input information through the operation unit 47 of the image forming apparatus 2. The communication section 104 acquires the input information about whether or not the paper P is one-side printed paper from the image forming apparatus 2. The paper-amount determination section 103 refers to the acquired information to determine whether or not the paper P is one-side printed paper. The determination whether the paper P is one-side printed paper can be also made by a media sensor (not shown) provided along the paper transport path in the image forming apparatus 2.

If the paper P is not one-side printed paper (NO in step S13), the procedure goes to step S15 without correcting the threshold value in step S14, because the upper side of the paper P stacked on the stacking tray 80 is left blank.

If the paper P is one-side printed paper (YES in step S13), a predetermined value is used as the coverage rate X of the paper P to correct the threshold value A, which is used to determine whether or not the amount of the paper P stacked on the stacking tray 80 exceeds the allowable stack capacity of the stacking tray 80 (step S14).

Subsequent to the above process, the paper-amount determination section 103 compares the threshold value A with an amount B of light received by the light-receiving element 84 of the paper-amount detection sensor 81 (step S15).

If the amount B of the light received by the light-receiving element 84 is equal to or greater than the threshold value A (YES in step S15), the operation controller 102 controls the pair of ejection rollers 64 to stop ejecting the paper P (step S16).

Subsequent to the process in step S16, the communication section 104 transmits data indicating that the amount of the paper P stacked on the stacking tray 80 exceeds the allowable stack capacity of the stacking tray 80 and an instruction to suspend transport of paper, to the image forming apparatus 2 (step S17).

Upon receiving the data indicating that the amount of the paper P stacked on the stacking tray 80 exceeds the allowable stack capacity of the stacking tray 80 and the instruction to suspend transport of paper, which are transmitted from the finisher 1 through the communication section 203, the controller 201 of the image forming apparatus 2 controls the image forming unit 12 to stop forming images and also controls the transport rollers of the image forming apparatus 2 to stop transporting paper P. In addition, the controller 201 displays a predetermined alarm screen on the display section 473 of the operation unit 47 to notify users to take out the paper P from the stacking tray 80 (step S18).

If the amount B of the light received by the light-receiving element 84 is not equal to or greater than the threshold value A (NO in step S15), the operation controller 102 controls the ejection rollers 64 to eject paper P (step S19).

As described above, the finisher 1 according to the embodiment of the present disclosure includes the ejection port 65 from which paper P is ejected, the stacking tray 80 on which the paper P ejected from the ejection port 65 is stacked, the light-emitting element 83 that emits light to the top sheet of the paper P stacked on the stacking tray 80, the light-receiving element 84 that receives the light emitted from the light-emitting element 83 and then reflected off the top sheet of the paper P on the stacking tray 80, the communication section 104 that performs data communication with the image forming apparatus 2 and acquires the coverage rate of a side, which is exposed to the light emitted from the light-emitting element 83, of the top sheet of the paper P on the stacking tray 80, and the paper-amount determination section 103 that determines whether or not the amount of the paper P stacked on the stacking tray 80 exceeds a predetermined allowable stack capacity of the stacking tray 80 by comparing a predetermined threshold value with an amount of light received by the light-receiving element 84. In addition, the paper-amount determination section 103 corrects the threshold value by using the coverage rate acquired by the communication section 104 and compares the corrected threshold value with the amount of the light received by the light-receiving element 84. If the light amount is equal to or greater than the threshold value, the paper-amount determination section 103 determines that the amount of the paper P stacked on the stacking tray 80 exceeds the allowable stack capacity of the stacking tray 80.

Furthermore, the paper-amount determination section 103 decreases the threshold value as the coverage rate acquired by the communication section 104 increases.

According to the above-described configuration, correcting the threshold value in accordance with the coverage rate of the paper P allows the reflective sensor in use to determine whether or not the amount of paper P stacked on the stacking tray 80 exceeds the allowable stack capacity of the stacking tray 80 with higher accuracy in comparison with conventional apparatuses.

Furthermore, the finisher 1 according to the embodiment of the present disclosure is configured so that the communication section 104 acquires information indicating whether the paper P ejected from the ejection port 65 is one-side printed paper from the image forming apparatus 2, and if the paper P ejected from the ejection port 65 is one-side printed paper and the light emitted from the light-emitting element 83 impinges on the printed side of the one-side printed paper, the paper-amount determination section 103 corrects the threshold value by using a predetermined value as a coverage rate.

According to the above-described configuration, even though one-side printed paper with a previously printed side facing up is ejected from the ejection port 65, the use of the predetermined value as a coverage rate of paper P makes it possible to accurately determine whether or not the amount of the paper P stacked on the stacking tray 80 exceeds the allowable stack capacity of the stacking tray 80.

The present disclosure is not limited by the above-described embodiment and various modifications and changes can be made.

[First Modification]

In the embodiment above, when one-side printed paper with a previously printed side facing up is ejected from the ejection port 65, a predetermined value is used as the coverage rate of paper P to correct the threshold value; however, the present disclosure is not limited thereto.

A finisher according to the first modification includes a line sensor 85 (coverage-rate detection sensor) disposed along a paper transport path of the finisher (see FIG. 1). The line sensor 85 optically detects the coverage rate of paper P. In a case where one-side printed paper with a previously printed side facing up is ejected from the ejection port 65, the line sensor 85 of the finisher according to the first modification detects the coverage rate of the one-side printed paper when the one-side printed paper arrives at a position facing the line sensor 85.

Figure 7:
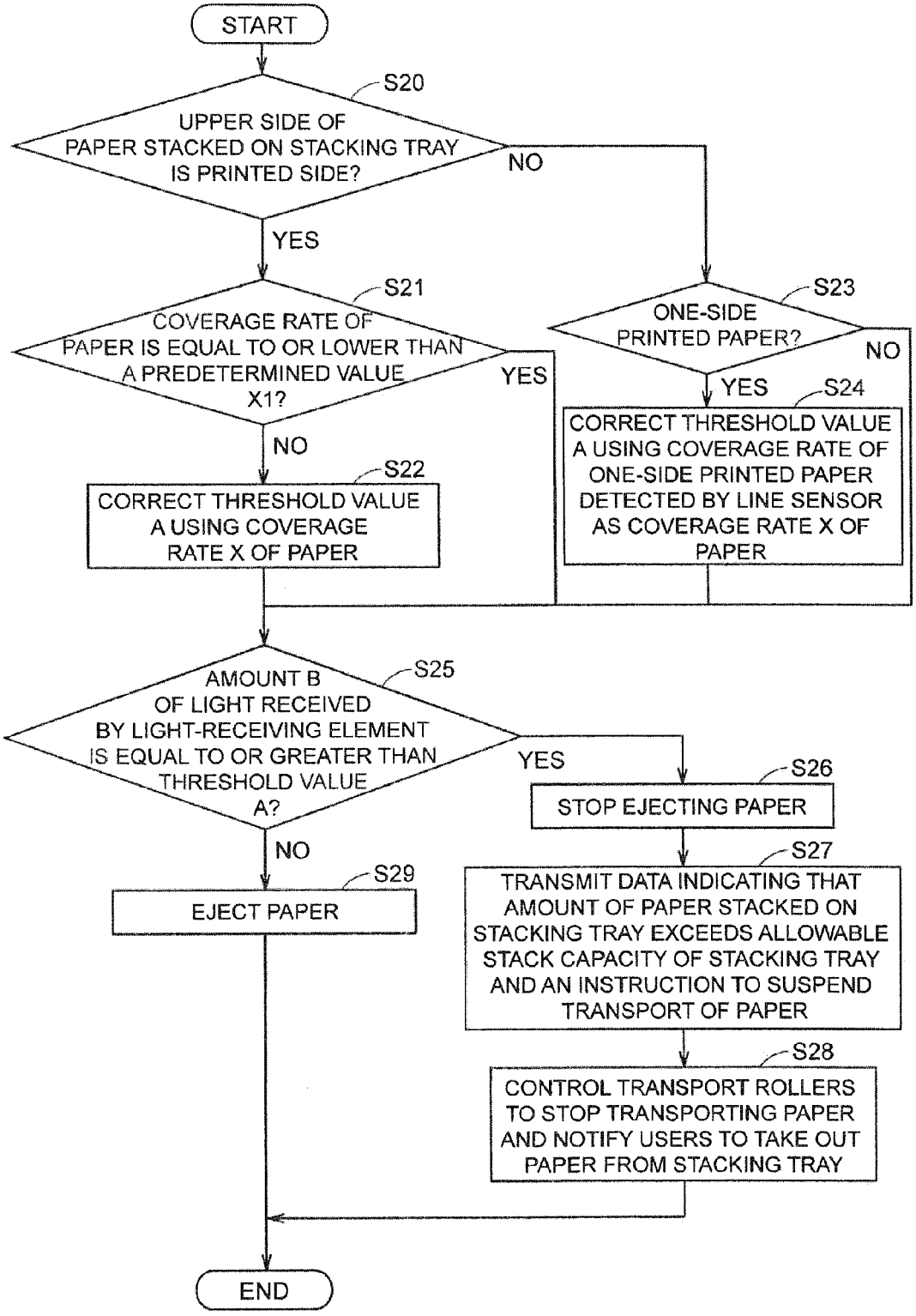
FIG. 7 is a flowchart showing an operational procedure performed by a finisher and an image forming apparatus according to the first modification.

FIG. 7 is a flowchart showing the operational procedure performed by the finisher and image forming apparatus according to the first modification. Descriptions on the same processes as those in the flowchart in FIG. 5 will be omitted.

In the process of step S23, the paper-amount determination section 103 determines whether or not the paper P is one-side printed paper. If the paper P is one-side printed paper (YES in step S23), the paper-amount determination section 103 uses the coverage rate of the one-side printed paper detected by the line sensor 85 as a coverage rate X of the paper P to correct the threshold value A, which is used to determine whether or not the amount of the paper P stacked on the stacking tray 80 exceeds the allowable stack capacity of the stacking tray 80 (step S24).

Subsequent to the process in step S24, the paper-amount determination section 103 compares the corrected threshold value A with an amount B of light received by the light-receiving element 84 of the paper-amount detection sensor 81 to determine whether or not the amount of the paper P stacked on the stacking tray 80 exceeds the allowable stack capacity of the stacking tray 80 (step S25).

Thus, the line sensor 85 can optically detect the coverage rate of the one-side printed paper with a previously printed side facing up ejected from the ejection port 65, and therefore it is possible to accurately determine whether or not the amount of the paper P stacked on the stacking tray 80 exceeds the allowable stack capacity of the stacking tray 80.

It is also possible to take the average of coverage rates of papers P that have been subjected to image formation in the past by the image forming apparatus 2 and to correct the threshold value A, which is used to determine whether or not the amount of the paper P stacked on the stacking tray 80 exceeds the allowable stack capacity of the stacking tray 80, by using the calculated average coverage rate value as a coverage rate of the one-side printed paper. Since the probability that one-side printed paper loaded on an image forming apparatus 2 is paper P on which images were printed in the past by the image forming apparatus 2 is high, taking the average coverage rates of papers P that have been subjected to image formation in the past can provide a relatively accurate coverage rate of the one-side printed paper.

[Second Modification]

Although the threshold value A is corrected by using a coverage rate acquired by the communication section 104 in the above-described embodiment, the present disclosure is not necessarily limited thereto. The threshold value A can be corrected by using the types of paper P, in addition to the coverage rate acquired by the communication section 104.

There is also a difference in light reflectance among the types of paper P to be stacked on the stacking tray 80. For example, glossy paper has a higher light reflectance than plain paper. These properties cause a difference in the amount of light received by the light-receiving element 84 of the paper-amount detection sensor 81 between the glossy paper and plain paper, even though the glossy paper sheets and plain paper sheets stacked on the stacking tray 80, respectively, are the same in number.

An image forming apparatus according to the second modification identifies the type of paper P from information input by users through the operation unit 47 of the image forming apparatus 2. The communication section 104 acquires the type of the paper P identified in the image forming apparatus 2 from the image forming apparatus 2. The paper-amount determination section 103 corrects the threshold value A by using the acquired type of the paper P and the coverage rate X of the paper P. Specifically, the following equation is used to obtain a corrected threshold value A1, for example.

A1=Y×Z×A0 (where A0 is a threshold value before being corrected, Y is a correction value in accordance with a coverage rate, and Z is a correction value in accordance with the type of the paper P)

The correction value Z in accordance with the type of the paper P in the equation is uniquely determined from the type of the paper P acquired by the communication section 104. For example, the correction value set for glossy paper P is lower than the correction value set for plain paper P. The table showing the corresponding relationship between types of paper P and correction values Z is stored in an internal HDD or other storage units in advance, and the paper-amount determination section 103 refers to the table to choose a correction value Z. Since the threshold value is thus corrected in accordance with the type of paper P in addition to the coverage rate of the paper P, the determination whether or not the amount of the paper P stacked on the stacking tray 80 exceeds the allowable stack capacity of the stacking tray 80 can be made accurately.

[Third Modification]

Although the coverage rate of the entire area of the paper P is calculated and the threshold value A is corrected by using the coverage rate of the entire paper P in the above embodiment, the present disclosure is not necessarily limited thereto.

It is also possible to acquire, from the image forming apparatus 2, a coverage rate of a specific area of the paper P where light emitted from the light-emitting element 83 impinges and to correct the threshold value A by using the coverage rate of the specific area.

The determination whether or not the amount of paper P stacked on the stacking tray 80 exceeds the allowable stack capacity of the stacking tray 80 can be made accurately by using the coverage rate of the specific area of the paper P where light emitted from the light-emitting element 83 impinges, rather than the coverage rate of the entire area of the paper P.

[Fourth Modification]

Although the threshold value A is corrected by using a coverage rate of one side (front side) of paper where light emitted from the light-emitting element 83 impinges in the above-described embodiment, the present disclosure is not necessarily limited thereto. In a case where paper P with images formed on both sides is ejected from the ejection port 65, it is possible to correct the threshold value A by using, in addition to the coverage rate of one side of paper where light emitted from the light-emitting element 83 impinges, the coverage rate of the other side.

Not only the coverage rate of the front side of the paper P, but also the back side of the paper P affects light reflectance. For example, paper with characters printed on the back side has a lower light reflectance than paper with a blank back side. These properties cause a difference in the amount of light received by the light-receiving element 84 of the paper-amount detection sensor 81, even though the sheets of both types of paper P on the stacking tray are the same in number.

According to the image forming apparatus of the fourth modification, the paper-amount determination section 103 corrects the threshold value A by using, in addition to a coverage rate X1 of a side of paper where light emitted from the light-emitting element 83 impinges, a coverage rate X2 of the back side of the paper. Specifically, the following equation is used to obtain a corrected threshold value A1, for example.

A1=0.9×Y1×A0+0.1×Y2×A0 (where A0 is a threshold value before being corrected, Y1 is a correction value in accordance with the front-side coverage rate X1, and Y2 is a correction value in accordance with the back-side coverage rate X2)

Since the threshold value is thus corrected by using the coverage rate of the back side of the paper P, in addition to the coverage rate of the front side of the paper P, the determination whether or not the amount of the paper P stacked on the stacking tray 80 exceeds the allowable stack capacity of the stacking tray 80 can be made more accurately.

[Fifth Modification]

Although the threshold value A is corrected by using a coverage rate acquired by the communication section 104 in the above-described embodiment, the present disclosure is not necessarily limited thereto.

There is also a difference in light reflectance among colors, for example, black, magenta, cyan, and yellow. These properties cause a difference in the amount of light received by the light-receiving element 84 of the paper-amount detection sensor 81, even though the sheets of paper printed with different colors on the stacking tray 80 are the same in number and the coverage rates are also the same.

According to the finisher 1 of the fifth modification, the threshold value A is corrected by using the ratio of black, magenta, cyan, and yellow used on the paper P in addition to the coverage rate X of the paper P. Specifically, the following equation is used to obtain a corrected threshold value A1, for example.

A1=Nbk×Ybk×A0+Nm×Ym×A0+Nc×Yc×A0+NY×YY×A0 (where A0 is a threshold value before being corrected, Nbk, Nm, Nc, NY represents a ratio of black, magenta, cyan, and yellow used, Ybk, Ym, Yc, YY are correction values in accordance with respective coverage rates X of black, magenta, cyan, and yellow)

The correction values Ybk, Ym, Yc, YY in the equation are uniquely determined in accordance with the coverage rates of the paper P acquired by the communication section 104. FIG.

8A is a table showing the corresponding relationship contents between magenta coverage rates and correction values, FIG. 8B is a table showing the corresponding relationship contents between cyan coverage rates and correction values, and FIG. 8C is a table showing the corresponding relationship contents between yellow coverage rates and correction values. As shown in FIGS. 6 and 8A to 8C, the corresponding relationships between coverage rates of black, magenta, cyan, and yellow and the correction values are different from one another for the respective colors. The finisher 1 according to the fifth modification having the tables, as shown in FIGS. 6 and 8A to 8C, stored in the internal HDD or other storage units in advance refers to the tables to choose correction values Y in accordance with the coverage rates X of the paper P acquired by the communication section 104 and corrects the threshold value using the correction values Y Since the threshold value is thus corrected by using the ratio of black, magenta, cyan, and yellow in addition to the coverage rates of the paper P, the determination whether or not the amount of the paper P stacked on the stacking tray 80 exceeds the allowable stack capacity of the stacking tray 80 can be made more accurately.

[Sixth Modification]

The above-described techniques to determine whether or not the amount of paper P stacked on the stacking tray 80 exceeds the allowable stack capacity of the stacking tray 80 can be applied to the image forming apparatus.

Figure 9:
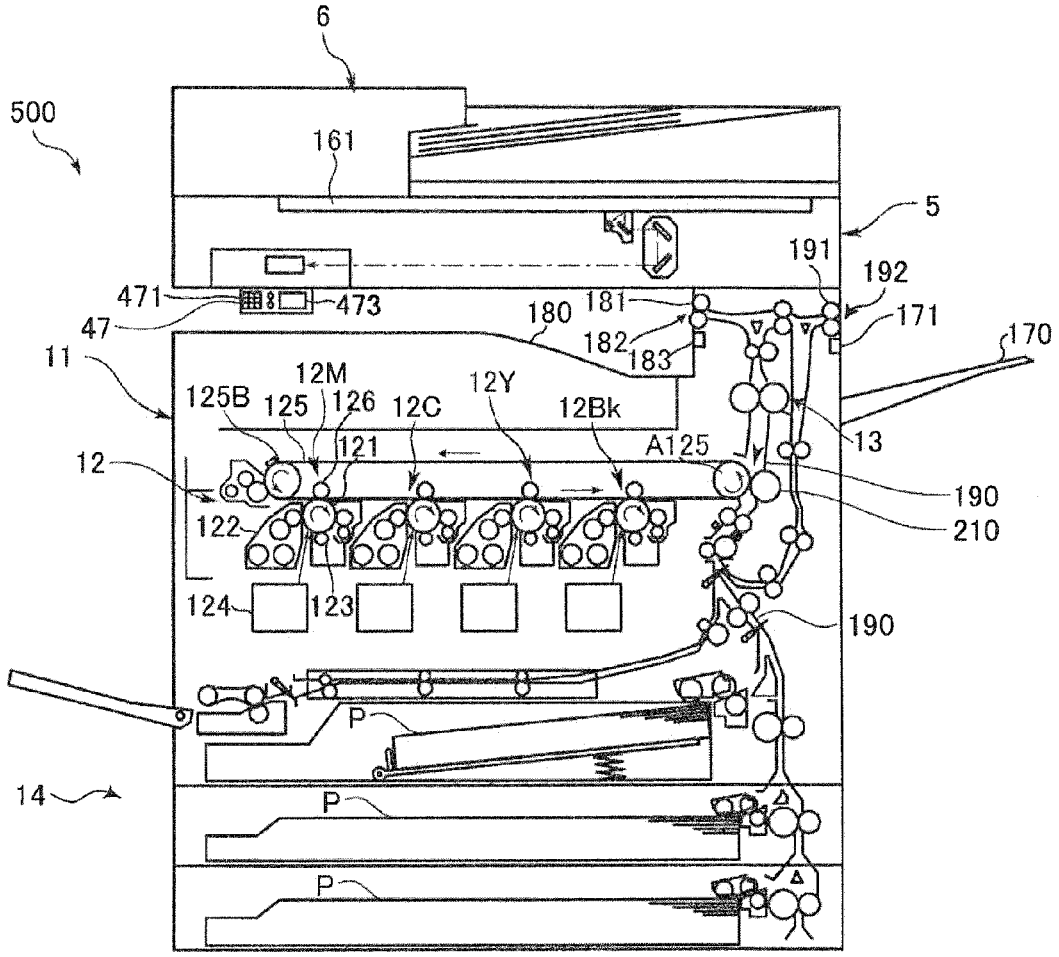
FIG. 9 illustrates the structure of an image forming apparatus according to the sixth modification.

FIG. 9 illustrates the structure of an image forming apparatus 500 according to the sixth modification. In FIG. 9, like components are denoted by like numerals as of the image forming apparatus 1 in FIG. 1 and the description thereof will not be reiterated.

Paper P on which images have been formed in the image forming apparatus 500 is ejected from an ejection port 192 by a pair of ejection rollers 191. A stacking tray 170 is provided below the ejection port 192, and the paper P ejected from the ejection port 192 is stacked on the stacking tray 170. Similar to the above-described embodiment, a paper-amount detection sensor 171 is disposed in the vicinity of the ejection port 192 above the stacking tray 170.

The paper-amount determination section of the image forming apparatus 500 determines whether or not the amount of paper P stacked on the stacking tray 170 exceeds the allowable stack capacity of the stacking tray 170 by using an amount of light received by a light-receiving element of the paper-amount detection sensor 171 and a coverage rate of the paper P calculated by a coverage-rate calculation section.

The image forming apparatus 500 is provided with a stacking tray 180, in addition to the stacking tray 170, to which paper P on which images have been formed is ejected. The paper P on which images have been formed is ejected by a pair of ejection rollers 181 from an ejection port 182 and stacked on the stacking tray 180. Similarly, a paper-amount detection sensor 183 is disposed in the vicinity of the ejection port 182 above the stacking tray 180.

The paper-amount determination section of the image forming apparatus 500 also determines whether or not the amount of paper P stacked on the stacking tray 180 exceeds the allowable stack capacity of the stacking tray 180 by using an amount of light received by a light-receiving element of the paper-amount detection sensor 183 and a coverage rate of the paper P calculated by the coverage-rate calculation section.

What is claimed is:

1. A finisher comprising:

an ejection port from which sheets of paper are ejected;

a stacking tray on which the sheets of paper ejected from the ejection port are stacked;

a light-emitting element configured to emit light to the top sheet of a paper stack on the stacking tray;

a light-receiving element configured to receive light that is emitted from the light-emitting element and then reflected off the top sheet of the paper stack on the stacking tray;

a communication section configured to perform data communication with an image forming apparatus and acquires a coverage rate of a side of the top sheet of the paper stack on the stacking tray, the side being exposed to light emitted from the light-emitting element; and a paper-amount determination section configured to determine whether or not the amount of paper stacked on the stacking tray exceeds a predetermined allowable stack capacity of the stacking tray by comparing a predetermined threshold value with an amount of light received by the light-receiving element, wherein the paper-amount determination section corrects the threshold value by using the coverage rate acquired by the communication section, compares the corrected threshold value with the amount of light received by the light-receiving element, and determines that the amount of paper stacked on the stacking tray exceeds the allowable stack capacity of the stacking tray if the light amount is equal to or greater than the corrected threshold value.

2. The finisher according to claim 1, wherein the paper-amount determination section decreases the threshold value as the coverage rate acquired by the communication section increases.

3. The finisher according to claim 1, wherein the communication section further acquires information indicating whether or not paper ejected from the ejection port is one-side printed paper from the image forming apparatus, and if the paper ejected from the ejection port is one-side printed paper and light emitted from the light-emitting element impinges on the printed side of the one-side printed paper, the paper-amount determination section corrects the threshold value by using a predetermined value as the coverage rate.

4. The finisher according to claim 1 further comprising a coverage-rate detection sensor that detects a coverage rate of one-side printed paper, wherein the communication section further acquires information indicating whether or not paper ejected from the ejection port is one-side printed paper from the image forming apparatus, and if the paper ejected from the ejection port is one-side printed paper and light emitted from the light-emitting element impinges on the printed side of the one-side printed paper, the paper-amount determination section corrects the threshold value by using the coverage rate of the one-side printed paper detected by the coverage-rate detection sensor.

5. The finisher according to claim 1, wherein the communication section further acquires the type of paper on which an image has been formed in the image forming apparatus from the image forming apparatus, and the paper-amount determination section corrects the threshold value by using the type of the paper in addition to the coverage rate acquired by the communication section.

6. The finisher according to claim 1, wherein the communication section further acquires a coverage rate of an area of the paper from the image forming apparatus, the area being exposed to light emitted from the light-emitting element, the paper-amount determination section corrects the threshold value by using the coverage rate of the area, which is exposed to the light emitted from the light-emitting element, of the paper.

7. The finisher according to claim 1, wherein the communication section further acquires information indicating whether or not images have been formed on both sides of paper from the image forming apparatus, and if paper with images formed on both sides is ejected from the ejection port, the paper-amount determination section corrects the threshold value by using a coverage rate of the other side of the paper in addition to a coverage rate of one side exposed to light emitted from the light-emitting element.

8. The finisher according to claim 1, wherein if the paper-amount determination section determines that the amount of paper stacked on the stacking tray exceeds the predetermined allowable stack capacity of the stacking tray, the communication section transmits data indicating the determination and an instruction to stop transporting paper to the image forming apparatus.

9. The finisher according to claim 1 further comprising an operation controller configured to control ejection operation of paper, wherein if the paper-amount determination section determines that the amount of paper stacked on the stacking tray exceeds the predetermined allowable stack capacity of the stacking tray, the operation controller controls an ejection roller provided at the ejection port to stop stacking paper on the stacking tray.

10. An image forming apparatus comprising:

an image forming unit configured to form an image on sheets of paper;

an ejection port from which the sheets of paper, on which the image has been formed by the image forming unit, are ejected;

a stacking tray on which the sheets of paper ejected from the ejection port are stacked;

a light-emitting element configured to emit light to the top sheet of a paper stack on the stacking tray;

a light-receiving element configured to receive light that is emitted from the light-emitting element and then reflected off the top sheet of the paper stack on the stacking tray;

a coverage-rate calculation section configured to calculate a coverage rate of a side of the top sheet of the paper stack on the stacking tray, the side being exposed to light emitted from the light-emitting element; and a paper-amount determination section configured to determine whether or not the amount of paper stacked on the stacking tray exceeds a predetermined allowable stack capacity of the stacking tray by comparing a predetermined threshold value with an amount of light received by the light-receiving element, wherein the paper-amount determination section corrects the threshold value by using the coverage rate calculated by the coverage-rate calculation section, compares the corrected threshold value with the amount of light received by the light-receiving element, and determines that the amount of the paper stacked on the stacking tray exceeds the predetermined allowable stack capacity of the stacking tray if the light amount is equal to or greater than the corrected threshold value.

11. An image forming system comprising:

an image forming apparatus; and a finisher coupled to the image forming apparatus, wherein the image forming apparatus includes an image forming unit configured to form an image on sheets of paper, and a coverage-rate calculation section configured to calculate a coverage rate of paper with an image formed by the image forming unit, and the finisher includes an ejection port from which the sheets of paper with the image formed by the image forming unit are ejected, a stacking tray on which the sheets of paper ejected from the ejection port are stacked, a light-emitting element configured to emit light to the top sheet of a paper stack on the stacking tray;

a light-receiving element configured to receive light that is emitted from the light-emitting element and then reflected off the top sheet of the paper stack on the stacking tray, a communication section configured to perform data communication with the image forming apparatus and acquires a coverage rate calculated by the coverage-rate calculation section, and a paper-amount determination section configured to determine whether or not the amount of paper stacked on the stacking tray exceeds a predetermined allowable stack capacity of the stacking tray by comparing a predetermined threshold value with the amount of light received by the light-receiving element, wherein the paper-amount determination section corrects the threshold value by using the coverage rate acquired by the communication section, compares the corrected threshold value with the amount of the light received by the light-receiving element, and determines that the amount of the paper stacked on the stacking tray exceeds the allowable stack capacity of the stacking tray if the light amount is equal to or greater than the corrected threshold value.

* * * * *